United States Patent [19]

Byrt

[11] 4,132,371

[45] Jan. 2, 1979

[54] APPARATUS FOR WEB FEED

[75] Inventor: Graham A. B. Byrt, Bristol, England

[73] Assignee: Masson Scott Thrissell Engineering Ltd., London, England

[21] Appl. No.: 861,243

[22] Filed: Dec. 16, 1977

[30] Foreign Application Priority Data

Dec. 21, 1976 [GB] United Kingdom ..... 53347/76

[51] Int. Cl.[2] ..... B65H 19/14

[52] U.S. Cl. ..... 242/58.3; 156/504

[58] Field of Search ..... 242/58.3, 58.1, 58.2, 242/58.4, 58.5; 156/502, 504, 505

[56] References Cited

U.S. PATENT DOCUMENTS

| | | | |
|---|---|---|---|
| Re. 29,365 | 8/1977 | Butler | 242/58.3 |
| 2,147,617 | 2/1939 | McCleery | 242/58.3 |
| 3,103,320 | 9/1963 | Huck | 242/58.3 |
| 3,974,490 | 8/1976 | Mori | 242/58.1 |

*Primary Examiner*—Edward J. McCarthy
*Attorney, Agent, or Firm*—Seidel, Gonda & Goldhammer

[57] ABSTRACT

To join the start of a new web to an expiring web a splicing assembly is provided which includes a light source and photoelectric cell. When a splice is to be effected, the splicer is moved towards the new reel and when the light beam is interrupted by the periphery of the reel the splicer is stopped in the correct position for splicing, and the position of the cell used as an indication of the diameter of the reel; a signal from the cell also causing the reel to be driven at such a speed that the speed of the new reel matches the linear speed of the old web so that the splice may be effected properly.

6 Claims, 3 Drawing Figures

APPARATUS FOR WEB FEED

This invention relates to web feed apparatus and more particularly to apparatus in which a splicer capable of effecting a splice on a moving web is employed to enable continuous feed of the web even when one supply reel is emptied and the supply of web has to be taken from a fresh reel. The invention has especial application in connection with the supply of paper web to consuming machines and we therefore refer to paper web below but it should be understood that it is also possible to apply the invention to apparatus for feeding webs of other materials.

Whenever a so-called "flying splice" has to be effected i.e. a splice on a moving web so as to join the leading end of a new web (i.e. web from a fresh, full reel) to a web running from a reel which is about to be exhausted, a need arises to feed the new web at a linear speed which is substantially equal to that of the running web. As the linear speed of the web leaving the fresh reel depends upon the reel diameter as well as its angular velocity and it is generally impracticable (or at least uneconomic) to wind paper reels to a sufficiently uniform diameter, it becomes necessary to provide some form of web speed control.

It is an object of the present invention to provide apparatus for feeding a continuous web (e.g. of paper) including means for splicing new web from a fresh reel to web running from a reel approaching exhaustion without stopping the web in which improved means are provided for indicating the diameter of the fresh reel so that the angular velocity of the fresh reel may be controlled to give a desired linear speed of the web.

According to the invention, web feed apparatus comprises a first reel support, a second reel support, and a splicer operable to join a leading end of web from a reel carried by said first support to a running web feeding from a reel carried by said second support, said first support being movable to a datum position after loading of a fresh reel thereon, including a sensing device movable towards the circumferential surface of said reel at said datum position, said sensing device being adapted to respond to proximity of said reel, and means under control of said sensing device for stopping the movement of the sensing device so that the sensing device stops in a position dependent upon the reel diameter.

The sensing device may be connected to means for indicating its position and such indicating means may be calibrated in terms of reel diameter for direct reading of the latter parameter. Alternatively or additionally the sensing device may be coupled to a drive mechanism so that the position of the sensing device controls the speed of drive to the fresh reel.

It is especially convenient to mount the sensing device on the splicer — or to mount the sensing device and splicer in a common support — so that, as the sensing device is moved towards the circumferential surface of the fresh reel and stopped, the splicer is brought to a predetermined position relative to said fresh reel.

The sensing device may take various forms; at present we prefer to employ a photoelectric device arranged so that the passage of a light beam to a photoelectric detector is interrupted by the reel's periphery.

In order that the invention may be fully understood, a preferred form of apparatus embodying the invention will now be described with reference to the accompanying drawing, in which.

Figure 2:
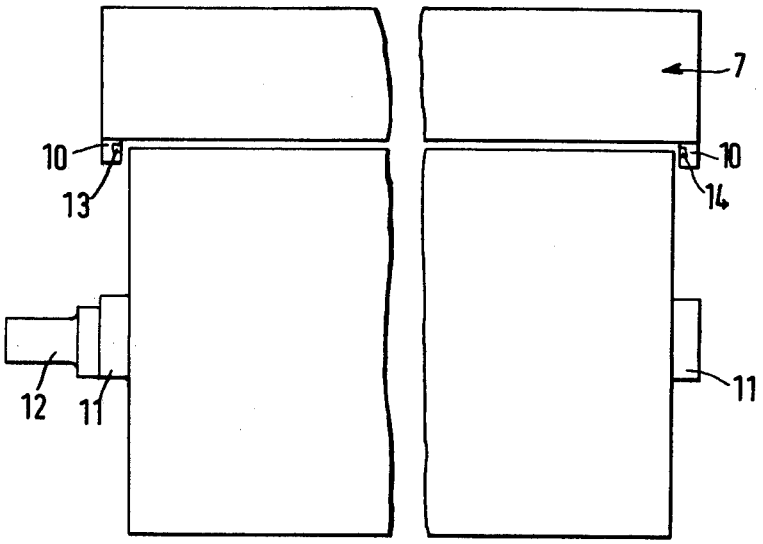
FIG. 2 is a fragmentary view in the direction of arrow II (FIG. 1)

Referring therefore to the drawing, a first reel support 1 of the type termed an "unwind stand" carries a fresh reel 2 of paper web and a second similar reel support 3 carries a reel 4 of paper web which is approaching exhaustion. Web 6 from the reel 4 feeds into a splicer assembly indicated at 7, the web 6 passing through the assembly 7 towards a consuming machine (not shown) as indicted at 8. The splicer assembly 7 is mounted above the reel 2 and is vertically movable as indicated by double headed arrow 9. The underside of the assembly 7 is provided with two projections 10 which overlap the reel 2 at its ends (FIG. 2).

The splicer mechanism is no part of the present invention but its operation is briefly as follows; the leading end of the web on the fresh reel is lightly held down to the next thickness of web by easily-broken tabs, and said leading end is also provided with an adhesive surface facing outwards by applying to it a piece 5 of double-sided adhesive tape. When a splice is to be made, the fresh reel is caused to rotate so that its peripheral speed equals the linear speed of the running web 6, and then an idler roller (not shown) in the splicer mechanism, above and parallel to the axis of the fresh reel 2 and above the path of the running web 6, is pressed down so as to urge the web 6 against the periphery of the reel 2 for at least one complete revolution of the latter. The idler roller then rises again, but while it is down, the leading end of the web on reel 2 passes through the nip formed by the idler roller on the reel and the adhesive surface of said leading end is pressed against the running web to join the leading end to it so that the running web 6 commences to pull the web from the fresh reel after it, breaking the tabs holding the leading end to the next thickness of web on reel 2. A knife (not shown) in the splicer mechanism operates at about the time the idler roller rises to cut the web 6 upstream of the nip between the idler roller and reel 2; the exact timing of the knife operation depends on how far upstream of the nip the knife is placed.

It will be appreciated that with such a splicer, efficient operation requires that the splicer mechanism should be suitably spaced above the fresh reel 2; as the diameter of reels of material such as paper is subject to considerable variation which cannot economically be avoided, it has been found desirable to provide for automatic positioning of the splicer assembly 7 above each fresh reel.

Figure 1:
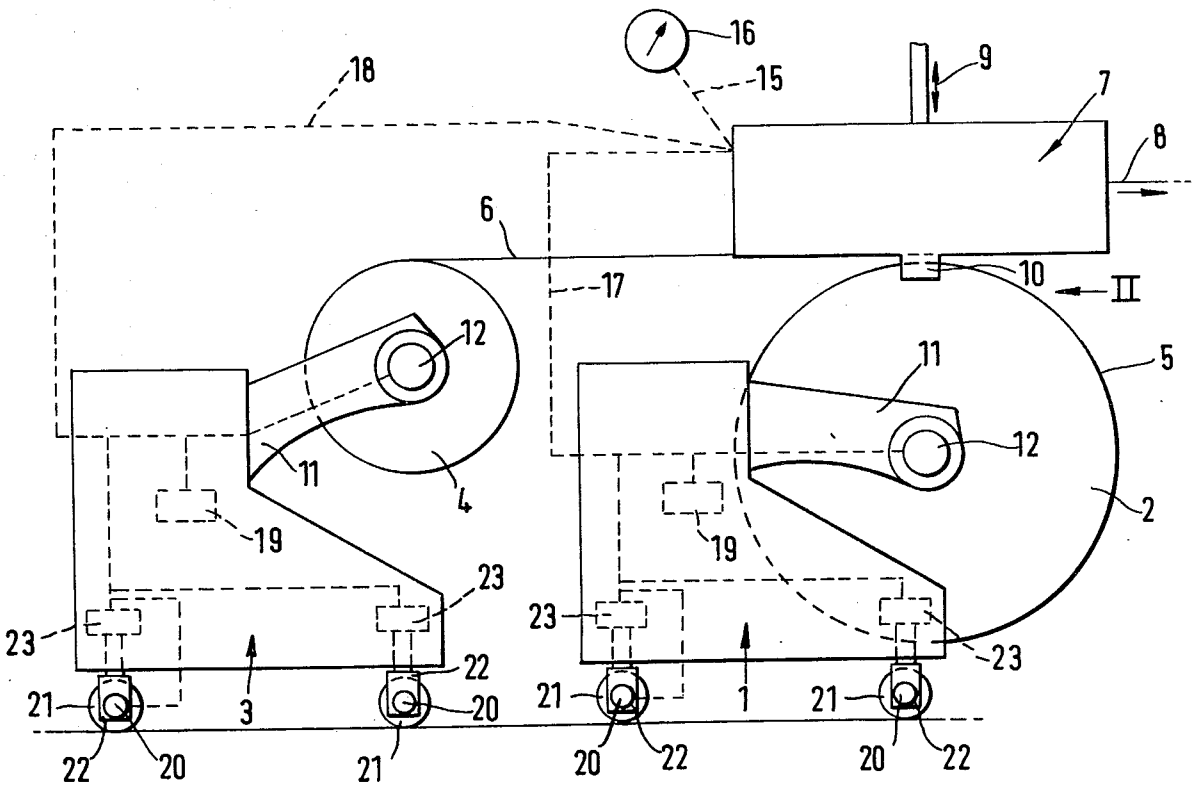
FIG. 1 is a diagrammatic side elevation of such apparatus.
Figure 3:
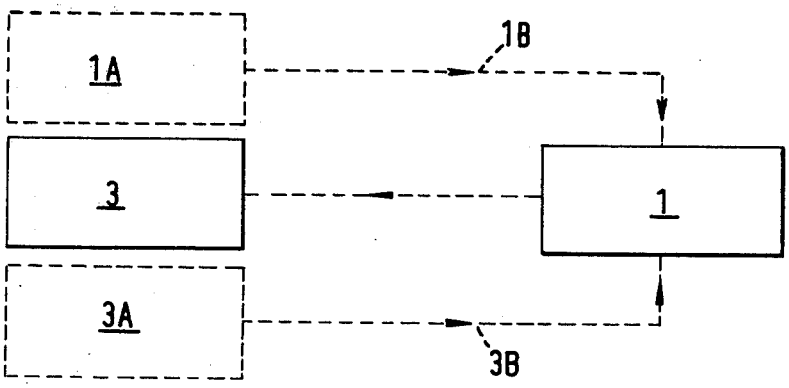
FIG. 3 is a diagrammatic plan view showing successive positions of various parts of the apparatus.

The two reel supports 1, 3 are each movable horizontally both in and at right angles to the plane of FIG. 1 as shown diagrammatically in FIG. 3. Assuming for the moment that the web 6 on reel 4 has been exhausted and a splice effected so that it is the web from reel 2 which is feeding to the right as viewed in FIG. 3, to the consuming machine (not shown), at this stage the reel support 3 is moved to the position 3A (FIG. 3) to permit the reel support 1 to be moved to the left so as to occupy the position vacated by reel support 3. A new full reel is loaded on to the reel support 3 and the latter is then moved along the path indicted by dashed line 3B into the position hitherto occupied by reel support 1.

As the paper web on reel 2 approaches exhaustion, a further splice may be effected so that web is drawn from the new full reel on the support 3, now positioned under the splicer. Then support 1 may be moved (in the same manner as previously described in relation to support 3) first to position 3A for loading of a further new full reel, then along path 3B back to its original position, the support 3 having meanwhile been moved to the left (as seen in FIG. 1).

Alternatively the support 1 may be moved along a path on the other side of the apparatus, i.e. to the position 1A for loading and then along path 1B. This requires much more floor space for the whole apparatus and thus is not generally acceptable, but the possibility of this arrangement is mentioned because it simplifies the provision of flexible electrical connections to the two supports 1, 3 as is required for control of mechanism with said supports, mentioned hereinafter.

One of the projections 10 contains a light source 13 and the other of said projections contains a photoelectric sensor 14 (e.g. a photocell or phototransistor). As shown in the drawings, the reel 2 lies partly between the two projections 10 and in this position prevents light from the source in one projection reaching the sensor in the other. However, when the reel support 1 is first placed in the position shown, with its arms 11 at the inclination illustrated, the splicer assembly 7 is in a higher position than that shown, so that the projections 10 are clear of the reel 2. After positioning of the support 1 and arms 11, so that the axis of reel 2 is in its datum position as shown, splicer assembly 7 is lowered and at the start of this lowering light from the source 13 in one of projections 10 illuminates the sensor 14 in the other projection. When the projections 10 overlap reel 2 sufficiently, as is seen from FIG. 2, the sensor 14 ceases to be illuminated, and a resulting signal from the sensor is communicated to control means (not shown) which stops the lowering of the splicer assembly 7. Thus whatever the diameter of the reel 2, the assembly 7 is brought to a preselected position above said reel, this position of the assembly 7 being directly related to the reel diameter. Movement of the assembly 7 is communicated by any convenient form of link 15 (e.g. a mechanical or electrical link) to an indicator 16 which indicates the position of assembly 7 but is conveniently calibrated in reel diameter.

A further link 17 — in this case most conveniently an electrical link — connects assembly 7 to the motor 12 of reel support 1 and causes the motor 12 to operate at a speed inversely proportional to reel diameter so that web 5 is fed at a linear speed matched to that of the running web 6 when a splice is to be made. A similar link 18 connects assembly 7 to the motor 12 of reel support 3; it will be appreciated that this link does not cause the speed of the motor of support 3 to be inversely proportional to the diameter of reel 2 when the reel supports are in the positions shown but upon changeover of the reel supports 1, 3 then the functions of links 17, 18 are interchanged by switching (not shown) within assembly 7.

The links 17, 18 also contain electrical connections for control of other mechanisms in reel supports 1, 3. A hydraulic mechanism 19 is provided in each support for raising and lowering reel-supporting arm 11; hydraulic or electric motors 20 are provided for driving wheels 21 on which the supports are carried; the wheels 21 are carried in mountings 22 each of which is rotatable about a vertical axis, and hydraulic mechanisms 23 are provided to turn the mountings 22 to steer the supports when they are moving due to operation of motors 20. The motors 20 and mechanisms 23 thus together produce the movements of the supports described above with reference to FIG. 3. The mechanisms just mentioned are diagrammatically indicated in FIG. 1, wherein control connections are shown as dashed lines. The links 17, 18 thus comprise multi-core electric cables and if, as preferred, the two supports 1, 3 move in succession along the same path, then provision has to be made to prevent the cables twisting together. For this purpose, a rotary connector (not shown) may be mounted in the region enclosed by the path of the supports, such connector having slip-rings through which the flexible cables are connected to static wiring which completes the links 17, 18.

I claim:

1. Web feed apparatus comprising a first reel support, a second reel support, and a splicer operable to join a leading end of web from a reel carried by said first support to a running web feeding from a reel carried by said second support, said first support being movable to a datum position after loading of a fresh reel thereon, including a sensing device movable towards the circumferential surface of said reel at said datum position, said sensing device being adapted to respond to proximity of said reel, and means under control of said sensing device for stopping movement of the sensing device so that the sensing device stops in a position dependent upon the reel diameter.

2. Apparatus as claimed in claim 1 in which said sensing device is connected to means for indicating its position, said indicating means being calibrated in terms of reel diameter.

3. Apparatus as claimed in claim 1 in which each of said first and second reel supports includes drive means for rotating a reel supported thereon.

4. Apparatus as claimed in claim 3 in which said sensing device is coupled to said drive means so that the position of the sensing device controls the speed of drive to said fresh reel from the associated drive means.

5. Apparatus as claimed in claim 4 in which said sensing device is mounted on said splicer so that as said sensing device is moved towards the circumferential surface of said fresh reel and stopped, the splicer is brought to a predetermined position relative to said fresh reel.

6. Apparatus as claimed in claim 5 in which said sensing device comprises a photoelectric device arranged so that the passage of a light beam to a photoelectric detector is interrupted by the periphery of said fresh reel.

* * * * *